US008770322B2

(12) United States Patent
Drenth et al.

(10) Patent No.: US 8,770,322 B2
(45) Date of Patent: Jul. 8, 2014

(54) LATCH BODY COMPONENTS HAVING MULTIPLE FUNCTIONS, AND DRILLING HEAD ASSEMBLY INCORPORATING SAME

(75) Inventors: Christopher L. Drenth, Draper, UT (US); Anthony LaChance, Mississauga (CA); George Iondov, Mississauga (CA)

(73) Assignee: Longyear TM, Inc., South Jordan, UT (US)

( * ) Notice: Subject to any disclaimer, the term of this patent is extended or adjusted under 35 U.S.C. 154(b) by 2 days.

(21) Appl. No.: 13/593,338

(22) Filed: Aug. 23, 2012

(65) Prior Publication Data

US 2014/0054093 A1 Feb. 27, 2014

(51) Int. Cl.
*E21B 7/00* (2006.01)

(52) U.S. Cl.
USPC ..... 175/271; 175/263; 175/290; 175/417

(58) Field of Classification Search
USPC ..... 175/271, 263, 290, 403, 417, 246, 247
See application file for complete search history.

(56) References Cited

U.S. PATENT DOCUMENTS 6,029,758 A * 2/2000 Novacovicci et al. ..... 175/234
2011/0079436 A1 4/2011 Drenth et al.

FOREIGN PATENT DOCUMENTS

WO 2011056077 A1 5/2011
WO 2012027817 A1 3/2012

OTHER PUBLICATIONS

International Search Report and the Written Opinion of the International Searching Authority for Application No. PCT/US2012/052063 (mailed Mar. 19, 2013).

* cited by examiner

*Primary Examiner* — Jennifer H Gay
*Assistant Examiner* — Elizabeth Gitlin
(74) *Attorney, Agent, or Firm* — Ballard Spahr LLP

(57) ABSTRACT

A latch body for use in a drilling head assembly including a fluid control subassembly, a check valve element, and/or a hollow spindle. A distal end portion of the latch body includes a port section that defines a chamber for receiving the check valve element and promoting movement of the check valve element between a blocking position and an open position. The hollow spindle of the fluid control subassembly is operatively coupled to the chamber of the port section and supports the check valve element in the blocking position. A proximal end portion of the latch body supports the fluid control subassembly of the drilling head assembly in an operative position. The latch body includes male protrusions extending inwardly toward and spaced from a longitudinal axis of the latch body. A plurality of channels extend radially outwardly from the longitudinal axis of the latch body, spanning between adjacent male protrusions.

26 Claims, 8 Drawing Sheets

LATCH BODY COMPONENTS HAVING MULTIPLE FUNCTIONS, AND DRILLING HEAD ASSEMBLY INCORPORATING SAME

FIELD

This application relates generally to drilling equipment and methods and, more particularly, to devices and methods for controlling fluid flow through core barrel head assemblies.

BACKGROUND

There is a need for core barrel head assemblies that provide improved tripping speed during descent into a drill string. Thus, there is a need for core barrel head assemblies that include mechanisms for (a) allowing standing fluid to pass through an inner tube for purposes of reducing drag during tripping of the head assembly into a hole while also (b) preventing drilling supply fluid from passing into the inner tube and damaging a core sample.

There is a further need for core barrel head assemblies that provide for improved fluid control during all drilling conditions. Thus, there is a need for core barrel head assemblies that include mechanisms for reliably creating pressure change signals that are detectable by a drill operator and for ensuring fluid communication between a drill rig and a drill bit, particularly during "lost circulation" conditions when it is crucial to avoid a loss of fluid pressure.

Conventional core barrel head assemblies are not equipped with mechanisms for—and are incapable of—meeting all of these needs in a single assembly configuration. Instead, multiple configurations are required, thereby increasing the costs and complexity of manufacturing, inventory logistics, and operator training. Accordingly, there is a need in the pertinent art for a single core barrel head assembly configuration that is configured to provide for both improved tripping speed and improved fluid control under all drilling conditions.

SUMMARY

Described herein is a latch body for use in a drilling head assembly. The drilling head assembly can include a fluid control subassembly, a check valve element, and/or a hollow spindle. The latch body can have a longitudinal axis, a longitudinal length, a proximal end portion, and a distal end portion. The latch body can define a central bore extending along the longitudinal length of the latch body through the proximal and distal end portions of the latch body.

The distal end portion of the latch body can include a port section that defines a chamber in fluid communication with the central bore. The port section can further define at least one port in fluid communication with the chamber. The chamber of the port section can be configured to receive at least a portion of the check valve element of the drilling head assembly. The chamber of the port section can have an inner surface configured to promote movement of the check valve element between a blocking position in which fluid flow through at least a portion of the chamber of the port section is blocked and an open position in which fluid flow through the chamber is permitted. The hollow spindle of the fluid control subassembly can be operatively coupled to, and positioned in fluid communication with, the chamber of the port section. The hollow spindle can be configured to support the check valve element in the blocking position. The latch body can further include a spring at least partially received within the chamber of the port section that is configured to bias the check valve element in the blocking position.

The proximal end portion of the latch body can be configured to support the fluid control subassembly of the drilling head assembly in an operative position. The fluid control subassembly can have a common longitudinal axis with the latch body. The fluid control subassembly can include a valve member configured for movement relative to the common longitudinal axis. The fluid control assembly can further include a spring positioned in abutting relation to the valve member and the proximal end portion of the latch body such that the spring is biased against the valve member.

The latch body can include a plurality of male protrusions extending inwardly toward and spaced from the longitudinal axis of the latch body. Each protrusion of the plurality of male protrusions can have a leading end spaced a selected distance from the longitudinal axis of the latch body. The latch body can also include a plurality of channels extending radially outwardly from the longitudinal axis of the latch body. Each channel of the plurality of channels can span between the leading ends of adjacent male protrusions.

Methods of using the described latch body and drilling head assembly are also disclosed.

BRIEF DESCRIPTION OF THE DRAWINGS

These and other features of the preferred embodiments of the invention will become more apparent in the detailed description in which reference is made to the appended drawings wherein:

FIGS. 1-3 is used to display the orientation and surface geometry of various components of the exemplary drilling head assemblies.

FIG. 1 displays an exemplary drilling head assembly having a spring-biased fluid control subassembly and a spring-biased check valve element.

FIG. 2 displays an exemplary drilling head assembly having a spring-biased fluid control subassembly and a gravity-biased check valve element.

FIG. 3 displays an exemplary drilling head assembly having a fluid-drag-biased fluid control element and a gravity-biased check valve element.

DETAILED DESCRIPTION

Figure 1:
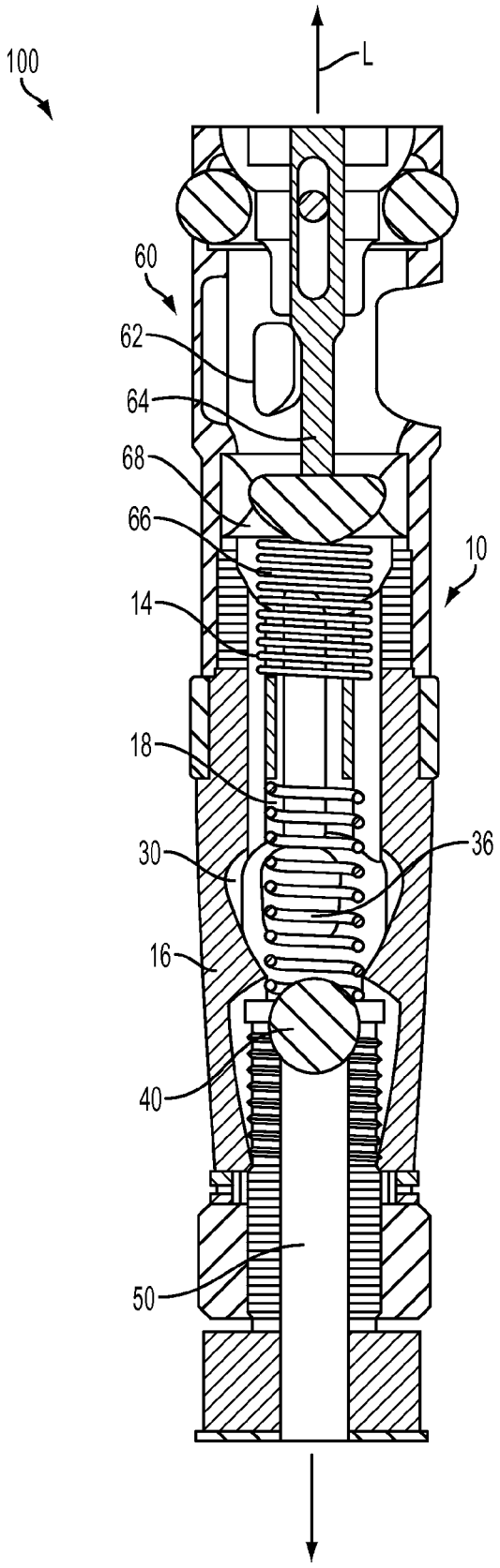
FIGS. 1-3 are partial cross-sectional views of exemplary drilling head assemblies as described herein. Some elements of the exemplary drilling head assemblies are shown in cross-section, while the distal end 16 of the latch body 10 of the exemplary drilling head assemblies is shown in partial broken-away perspective. The hatching shown within

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof. For instance, while the description below focuses on a drilling system used to trip a core barrel assembly into and out of a drill string, portions of the described system can be used with any suitable downhole or uphole tool, such as a core sample orientation measuring device, a hole direction measuring device, a drill hole deviation device, or any other suitable downhole or uphole object.

As used throughout, the singular forms "a," "an" and "the" include plural referents unless the context clearly dictates otherwise. Thus, for example, reference to "an inner tube" can include two or more such inner tubes unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

As used herein, the term "trip" or "tripping" refers to the periods of a drilling operation during which: (a) an empty inner tube assembly (not containing a sample) is advanced into a drill hole until the inner tube assembly reaches the bottom and/or end of the hole; or (b) a full inner tube assembly (containing a sample) is retrieved from the bottom and/or end of the hole. For example, tripping can refer to the dropping and/or lowering of an empty inner tube assembly into a down-angled hole until the inner tube assembly reaches a drilling position, the pumping of an empty inner tube assembly into an inclined hole until the inner tube assembly reaches a drilling position, as well as the wireline retrieval of a fully inner tube assembly from the drilling position until the inner tube assembly exits the hole. In exemplary applications, the inner tube assembly can comprise a head assembly, an inner tube, a core lifer, and a case.

Described herein with reference to FIGS. 1-7B is a latch body 10 for use in a drilling head assembly 100. In exemplary aspects, the drilling head assembly 100 can have a fluid control subassembly 60, a check valve element 40, and/or a hollow spindle 50. Although the drilling head assembly 100 can comprise any suitable component, in exemplary configurations, the drilling head assembly can comprise a drill string, an inner core barrel assembly comprising an inner core barrel, an outer core barrel assembly comprising an outer core barrel, and a retrieval tool that is connected to a cable. As described herein, the latch body 10 can comprise the inner and outer core barrel assemblies.

The drill string can include one or more sections of tubular drill rod that are connected together to create an elongated, tubular drill string. The drill string can have any suitable characteristic known in the art. For example, the drill rod can have any suitable length, depending on the drilling application. The drill rod sections can also have any suitable cross-sectional wall thickness. It is contemplated that at least one section of the drill rod in the drill string can have a varying cross-sectional wall thickness.

The drill string can be oriented at any angle, including angles ranging from about 30 degrees to about 90 degrees from a horizontal surface, whether for an up-hole or a downhole drilling process. Indeed, when the drilling head assembly 100 is used with a drilling fluid in a downhole drilling process, it is contemplated that a downward angle can help retain some of the drilling fluid at the bottom of a borehole. Additionally, it is contemplated that the downward angle can permit the use of a retrieval tool and cable to trip the inner core barrel from the drill string.

The inner core barrel can have any characteristic or component that allows it to connect a downhole object (e.g., a sample tube) with a retrieval tool such that the downhole object can be tripped in or out of the drill string. For example, the inner core barrel can comprise a retrieval point. The retrieval point of the inner core barrel can have any characteristic that allows it to be selectively attached to any retrieval tool, such as, for example and without limitation, an overshot assembly and/or a wireline hoist. For example, the retrieval point can be shaped like a spear point so as to aid the retrieval tool in correct alignment and coupling with the retrieval point. In another example, when the retrieval tool and the inner core barrel are to be handled outside of the drill hole, it is contemplated that the retrieval point can be pivotally attached to the inner core barrel so as to pivot in one plane with a plurality of detent positions.

In exemplary aspects, the latch body 10 can be a lower latch body that is configured for operative coupling to an upper latch body of the drilling head assembly 100. In these aspects, the upper latch body can comprise the fluid control subassembly 60. It is contemplated that the upper latch body can further comprise a latching mechanism that can retain a core sample tube in a desired position with respect to the outer core barrel while the core sample tube is filled. In order to not hinder the movement of the inner core barrel within the drill string, it is contemplated that the latching mechanism can be configured so that the latches do not drag against the interior surface of the drill string. Accordingly, this non-dragging latching mechanism can be any latching mechanism that allows it to perform this retaining function without dragging against the interior surface of the drill string during tripping. For instance, the latching mechanism can comprise a fluid-driven latching mechanism, a gravity-actuated latching mechanism, a pressure-activated latching mechanism, a contact-actuated mechanism, a magnetic-actuated latching mechanism, and the like. Consequently, in some aspects, the latching mechanism can be actuated by electronic or magnetic sub-systems, by valve works driven by hydraulic differences above and/or below the latching mechanism, or by another suitable actuating mechanism.

The latching mechanism can also comprise any component or characteristic that allows it to perform its intended purposes. For example, the latching mechanism may comprise any number of latch arms, latch rollers, latch balls, multi-component linkages, or any mechanism configured to move the latching mechanism into an engaged position when the inner core barrel is seated in an operative position. It is contemplated that the latching mechanism can comprise a detent mechanism that helps maintain the latching mechanism in an engaged or retracted position. It is further contemplated that such a detent mechanism can help hold the latching mechanism in contact with the interior surface of the drill string during drilling. The detent mechanism can also help the latching mechanism to stay retracted so as to not contact and drag against the interior surface of the drill string during any tripping action.

Figure 6:
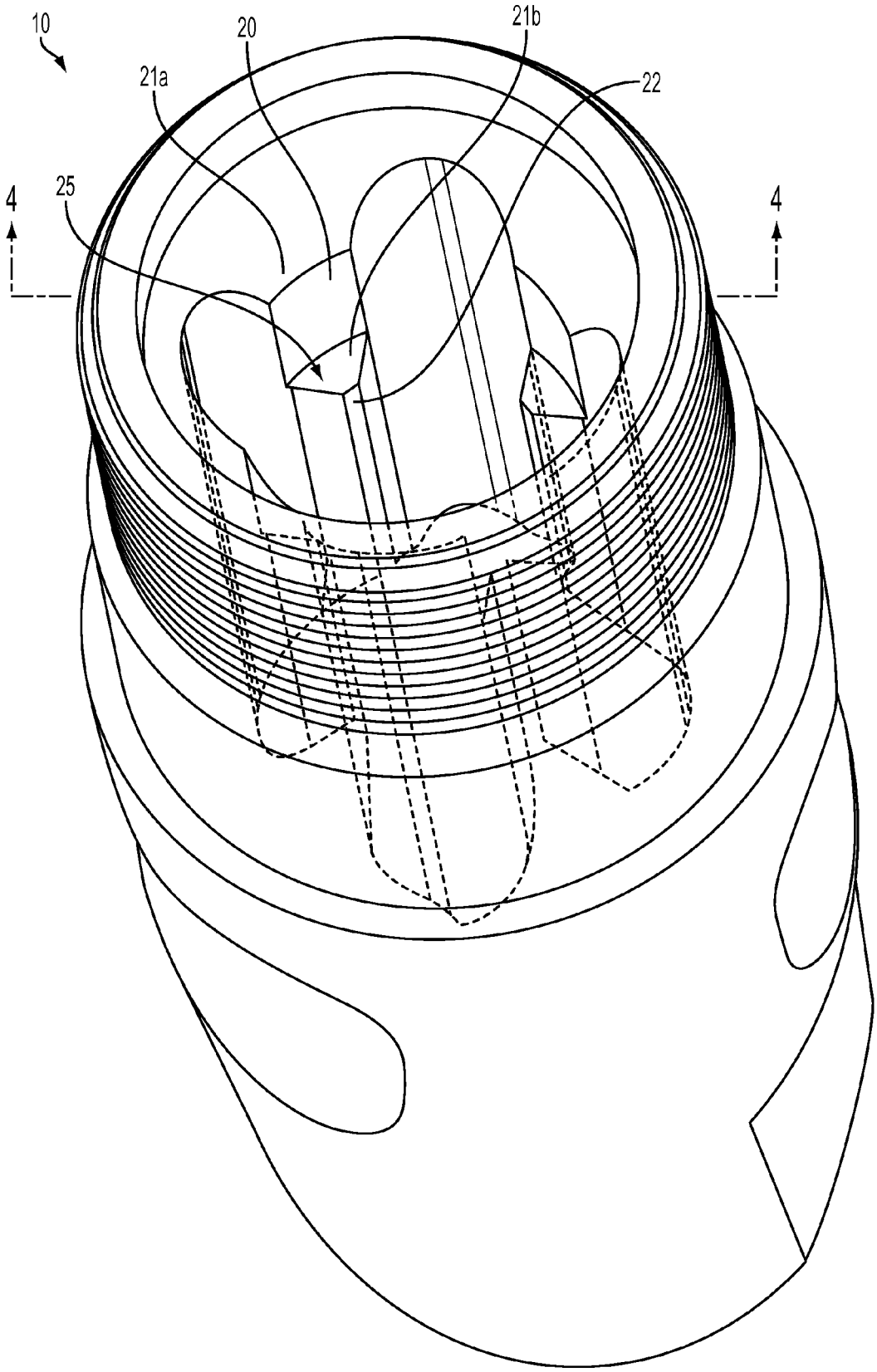
FIG. 6 is a partially transparent perspective view of the latch body of FIG. 4.
Figure 7A:
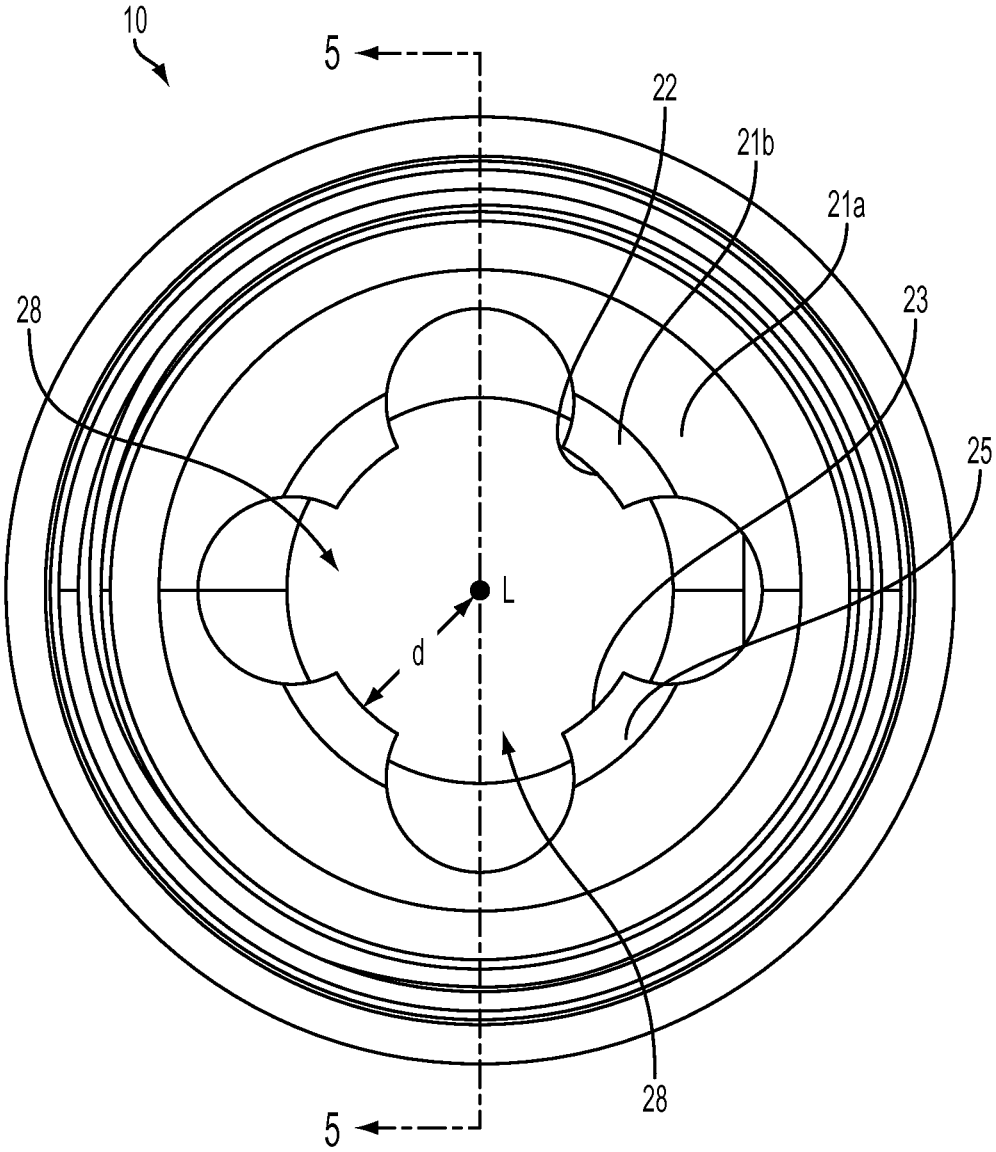
FIG. 7A is a top (proximal) perspective view of the latch body of FIG. 5.
Figure 7B:
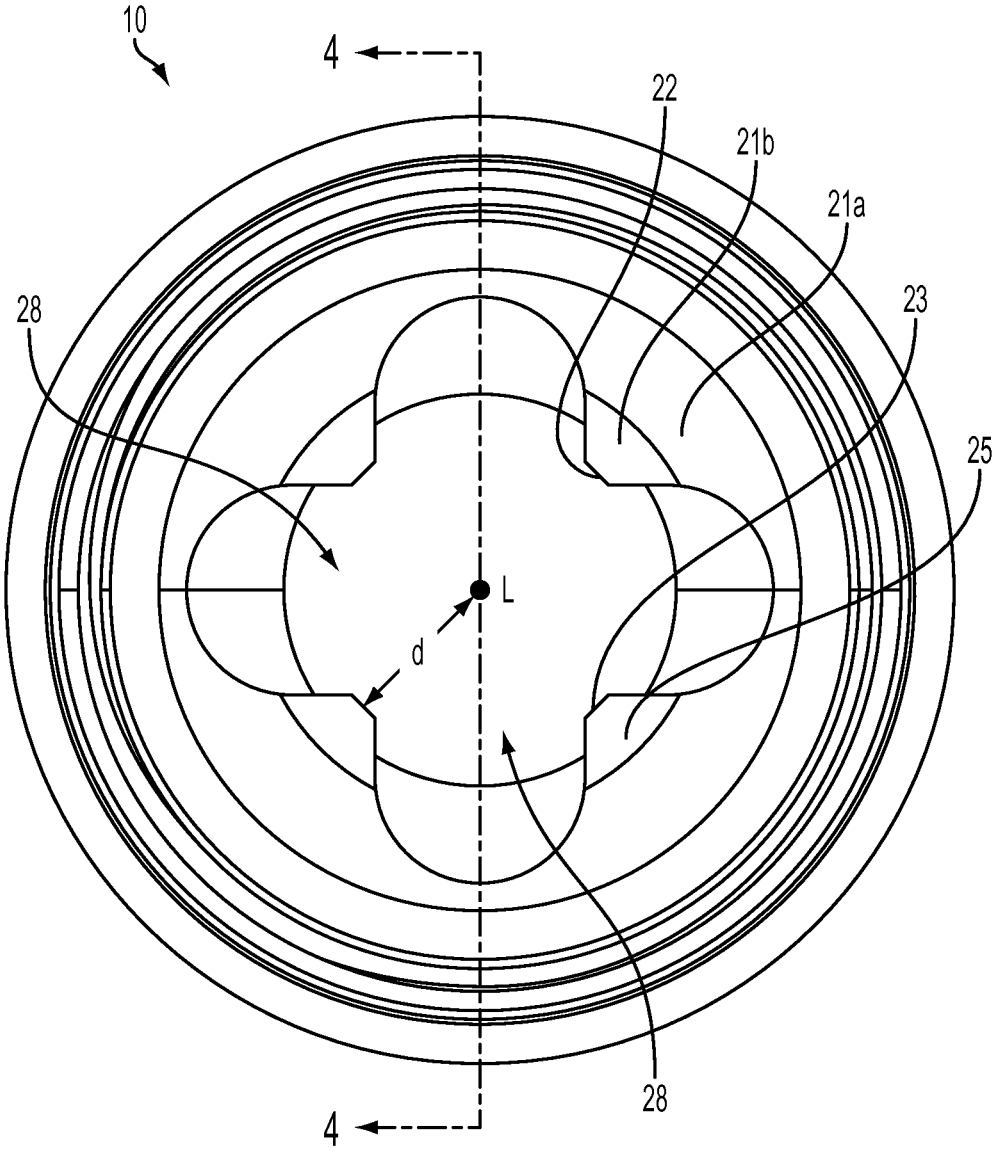
FIG. 7B is a top (proximal) perspective view of the latch body of FIG. 4.

In various aspects, it is contemplated that the latch body 10 can comprise any component or characteristic suitable for use with an inner core barrel. In one aspect, and with reference to FIGS. 1-5, the latch body 10 can have a longitudinal axis L, a longitudinal length 12, a proximal end portion 14, and a distal end portion 16. In this aspect, it is contemplated that the proximal end portion 14 of the latch body 10 can define a proximal end 15 of the latch body. It is further contemplated that the distal end portion 16 of the latch body 10 can define a distal end 17 of the latch body. As shown in FIGS. 6-7B, it is contemplated that the longitudinal axis L can be centrally positioned within the latch body 10 along the longitudinal length 12 of the latch body. In another aspect, the latch body 10 can define a central bore 18 extending along the longitudinal length 12 of the latch body through the proximal end portion 14 and the distal end portion 16. For example, it is contemplated that the central bore 18 of the latch body 10 can extend along the entire longitudinal length 12 of the latch body (between the proximal end 15 of the latch body and the distal end 17 of the latch body). It is further contemplated that, when the latch body 10 corresponds to a lower latch body, the central bore 18 of the latch body 10 can be in fluid communication with a complementary bore and/or channel of an upper latch body. In use, it is contemplated that the central bore 18 of the latch body can increase productivity by allowing fluid to flow directly through the latch body 10.

In still another aspect, and with reference to FIGS. 1-5, the distal end portion 16 of the latch body 10 can comprise a port section 30. In this aspect, the port section 30 can define a chamber 32 in fluid communication with the central bore 18 of the latch body. The port section 30 can further define at least one port 34 in fluid communication with the chamber 32. In exemplary aspects, it is contemplated that the ports 34 of the at least one port can be configured to increase passage of heavier drilling fluids, which are advantageous in stabilizing bad ground conditions. It is further contemplated that the ports 34 of the at least one port can be configured to increase the rate at which drilling fluids are provided to drive cuttings. It is still further contemplated that the port section 30 of the latch body 10 can comprise one or more materials that are configured to withstand high static and cyclic loads, such as, for example and without limitation, the vibration and impact loads experienced during drilling operations.

In exemplary aspects, it is contemplated that the chamber 32 of the port section 30 can be configured to receive at least a portion of the check valve element 40 of the drilling head assembly 100. Thus, in these aspects, the check valve element 40 is positioned within the latch body 10, thereby eliminating the need for a separate "check valve body" as is conventionally found in the art. In one exemplary aspect, the check valve element 40 can be a ball valve. However, it is contemplated that the check valve element 40 can be any conventional check valve element that provides the fluid control characteristics described herein.

In one aspect, the ports 34 of the at least one port of the valve body 10 can be shaped to prevent the check valve element 40 from exiting the ports. For example, in this aspect, it is contemplated that the ports 34 of the at least one port can have a diameter that is less than an outer diameter (or other outer dimension) of the check valve element 40.

Optionally, in various aspects, the chamber 32 of the port section 30 can have an inner surface configured to promote movement of the check valve element 40 between a blocking position in which fluid flow through at least a portion of the chamber is blocked and an open position in which fluid flow through the chamber is permitted. In an exemplary aspect, it is contemplated that a distal portion of the inner surface of the chamber 32 can have a substantially frusto-conical profile, with the inner surface being inwardly sloped relative to the longitudinal axis L of the latch body 10 moving from the proximal end 15 of the latch body to the distal end 17 of the latch body. Optionally, in this aspect, the distal portion of the inner surface of the chamber 32 can be inwardly sloped relative to the longitudinal axis L of the latch body 10 at an angle of less than about 40 degrees. In this aspect, it is further contemplated that the distal portion of the inner surface of the chamber 32 can be configured to minimize resistance to movement of the check valve element 40 as gravity pulls the check valve element from an open position into a blocking position. In the blocking position, it is contemplated that the check valve element 40 can form a fluid seal with a distal opening of the chamber 32 that is in communication with the central bore 18 of the latch body 10. It is contemplated that the open position of the check valve element 40 can correspond to a position of the check valve element that permits passage of standing fluid through the latch body 10 to reduce drag during tripping. It is further contemplated that, in any open position, the resistance to passage of fluid around the check valve element can be substantially equivalent. It is still further contemplated that the blocking position of the check valve element 40 can correspond to a position of the check valve element that prevents passage of drilling supply fluid into a core sample tube, thereby preserving a core sample within the core sample tube.

In exemplary aspects, the check valve element 40 can permit fluid to flow from a core sample tube to the central bore 18 while preventing fluid to flow from the central bore to the core sample tube. Accordingly, the check valve element 40 can be configured to allow fluid to pass into the central bore 18 and then through the inner core barrel when the inner core barrel is being tripped into the drill string and when the core sample tube is empty. In this manner, it is contemplated that fluid resistance can be lessened, thereby permitting the inner core barrel to be tripped into the drill string faster and more easily. On the other hand, when the inner core barrel is tripped out of the drill string, it is contemplated that the check valve element 40 can prevent fluid from pressing down on or damaging a core sample contained in core sample tube. Accordingly, the check valve element 40 can prevent the sample from being dislodged or lost. It is further contemplated that, when the check valve element 40 prevents fluid from passing through the latch body 10 and into the core sample tube (in the blocking position), the fluid can be forced to flow around the outside of the core sample tube and the latch body 10. It is still further contemplated that, when the check valve element 40 is in the blocking position, it can be configured to prevent and/or minimize washing or erosive damage to the core sample.

Optionally, in additional aspects, and as shown in FIG. 1, the latch body 10 can further comprise a spring 36 at least partially received within the chamber 32 of the port section 30. In these aspects, the spring 36 can be configured to bias the check valve element 40 in the blocking position. It is contemplated that during downhole drilling, the force of gravity can ensure proper biasing of the check valve element 40; in contrast, during uphole drilling, when the force of gravity is applied in the opposite direction, the spring 36 can be used to properly bias the check valve element. In one exemplary aspect, a first portion of the spring 36 can be received within the chamber 32, and a second portion of the spring can be received within the central bore 18 of the latch body 10 (in between the port section 30 and the proximal end portion 14 of the latch body). In a further aspect, the spring 36 can be configured to lift the weight of the check valve element 40. In this aspect, it is contemplated that the spring 36 can comprise light, widely spaced wire to thereby limit resistance to fluid flow.

Figure 2:
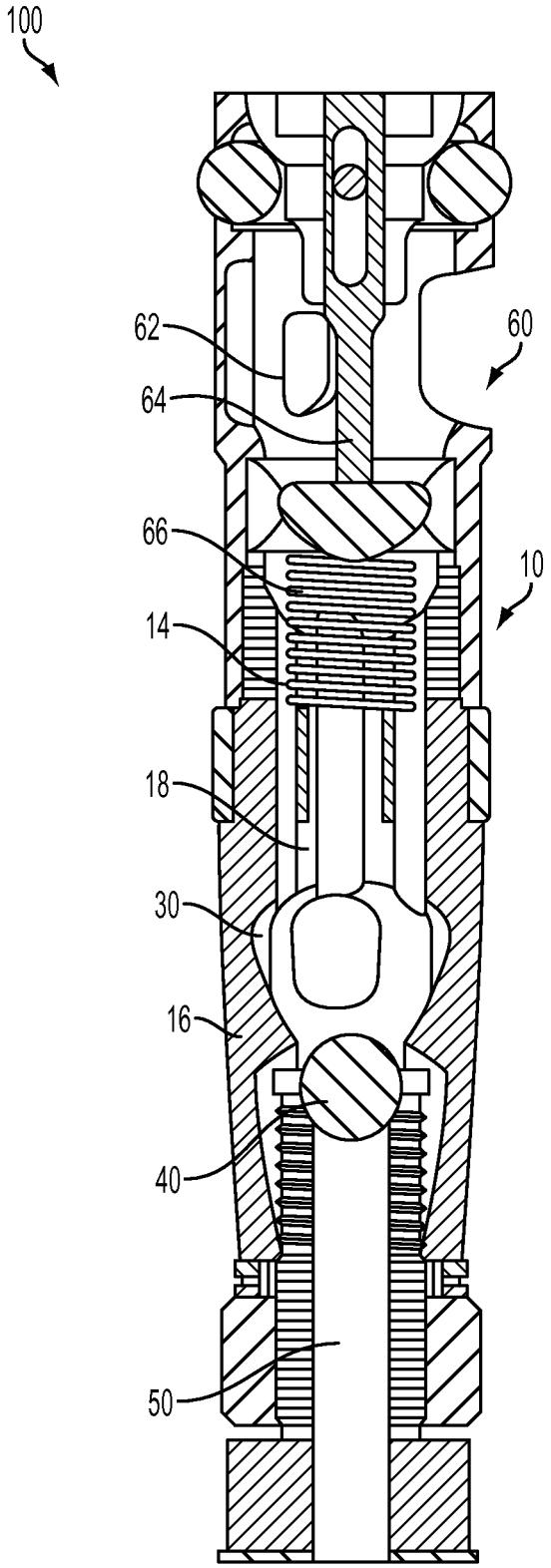
Figure 3:
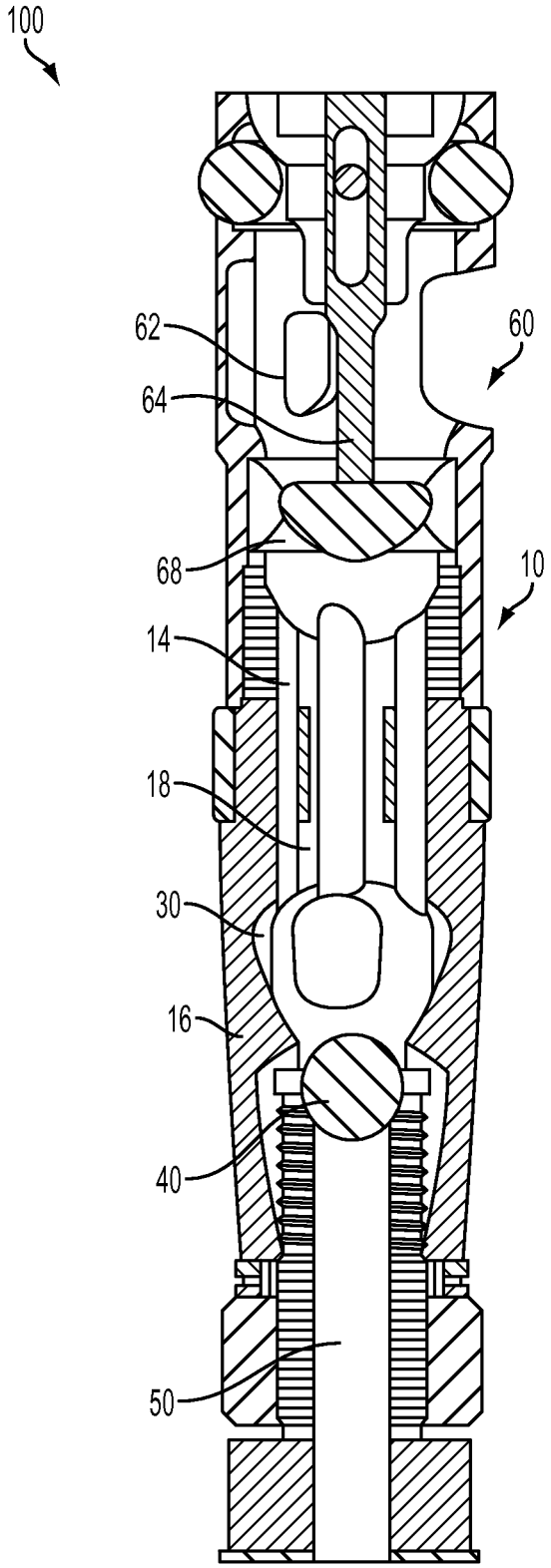

In another exemplary aspect, and with reference to FIGS. 1-3, the fluid control subassembly 60 can comprise a valve chamber 62 and a valve member 64. In this aspect, the valve chamber 62 can be positioned in fluid communication with the central bore 18 of the latch body 10. It is contemplated that the valve chamber 62 can share a common longitudinal axis L with the latch body 10. It is further contemplated that the proximal end portion 14 of the latch body 10 can be configured to support the fluid control subassembly 60 in an operative position. For example, it is contemplated that the valve chamber 62 can be positioned in abutting relation to the proximal end 15 of the latch body 10. It is still further contemplated that at least a portion of the valve member 64 can be positioned within the valve chamber 62 and configured for movement relative to the common longitudinal axis L. In exemplary aspects, the valve member 64 can be an elongate piston (as shown in FIGS. 1-3). However, it is contemplated that the valve member 64 can be any known fluid control valve element, including, for example and without limitation, a ball valve.

Optionally, in an additional aspect, the fluid control subassembly 60 can comprise a spring 66 that is positioned within the valve chamber 62 such that the spring abuts a portion of the proximal end portion 14 of the latch body 10 and is biased against the valve member 64. In a further optional aspect, the fluid control subassembly 60 can comprise a bushing 68 mounted within the valve chamber 62 and axially surrounding at least a portion of the spring 66. In this aspect, it is contemplated that the bushing 68 can be configured to restrict fluid flow and create pressure change signals (e.g., higher pressure signals) that are delivered to a drill operator as the valve member 64 moves relative to longitudinal axis L. It is further contemplated that the valve member 64 can optionally be configured for positioning within the bushing 68 in an interference fit, thereby permitting the bushing 68 to operate as a pressure indicator. It is contemplated that, when the valve member 64 is configured for positioning within the busing 68 in an interference fit, the bushing can comprise nylon or other like materials. However, it is further contemplated that, when the valve member 64 is not configured for positioning within the bushing 68 in an interference (i.e., when there is some amount of clearance), the bushing can comprise steel or other like materials.

In exemplary aspects, it is contemplated that the spring 66 can provide adequate resistance to the valve member 64 to ensure that at least some fluid is delivered to a drill bit of the drilling head assembly 100. For example, the spring 66 can resist the creation of an elevated fluid pressure by the valve member 64, thereby ensuring fluid communication between a drill rig and the drill bit. In exemplary aspects, the spring 66 can have sufficient stiffness to generate large resistance loads that exert significant fluid flow pressure (ranging from about 500 to about 1,500 psi) and resist fluctuation, thereby providing a smooth response and reliable fluid control. In these aspects, the spring 66 can comprise a die spring or other spring having heavy rectangular section wire as are conventionally known in the art. It is contemplated that, without the spring 66 to resist the valve member 64, some fluid can be lost to a ground formation. In exemplary aspects, the bushing 68 can be positioned in abutting relation to the proximal end 15 of the latch body 10. In these aspects, it is contemplated that the proximal end 15 of the latch body 10 can function as a landing shoulder for the bushing 68. Thus, it is contemplated that the latch body 10 can provide both (1) a seat for spring 66 and/or bushing 68 of the fluid control subassembly 60 and (2) a housing for check valve element 40.

In various exemplary aspects, it is contemplated that the fluid control subassembly 60 can be configured to control the amount of drilling fluid that passes through the inner core barrel during tripping and/or drilling. In these aspects, it is contemplated that the fluid control subassembly 60 can have any characteristic or component consistent with these functions. In another aspect, it is contemplated that the valve member 64 can be coupled to an outer core barrel by any known connector, such as a pin. In this aspect, it is further contemplated that the pin can travel within an axial slot such that the valve member 64 can move axially with respect to both the inner core barrel and the outer core barrel. In exemplary aspects, when the fluid control subassembly comprises bushing 68, the valve member 64 can axially move between an open position and a closed position through interaction with the bushing 68. Optionally, the fluid control subassembly 60 can be configured for engagement with a fluid supply pump, with the fluid supply pump being configured to deliver fluid and pressure to generate fluid drag across the valve member 64 such that the valve member engages and/or moves past the bushing 68.

In exemplary aspects, the inner core barrel can comprise one or more fluid ports that are in fluid communication with the exterior of the inner core barrel. In use, when the valve member 62 is in an open position, it is contemplated that fluid can flow from the (lower) latch body 10, through the fluid control subassembly 60 (and past and/or around the valve member), and through the fluid ports of the inner core barrel. With the valve member in the open position, the latching mechanism can be positioned in a retracted position and configured for insertion into the drill string. Optionally, in this open position, it is contemplated that fluid can flow from the (lower) latch body 10 to the upper latch body, but fluid pressure can force the valve member 62 toward the bushing 68, thereby causing the valve member to press against the bushing and prevent fluid flow.

In an additional aspect, and with reference to FIGS. 4-7B, the latch body 10 can comprise a plurality of male protrusions 20 extending inwardly toward and spaced from the longitudinal axis L of the latch body. In this aspect, each protrusion of the plurality of male protrusions can have a leading end 22 spaced a selected distance d from the longitudinal axis L of the latch body 10. Optionally, in another aspect, the leading end 22 of each protrusion 20 of the plurality of male protrusions can comprise an edge surface 23. Optionally, as shown in FIG. 7B, the edge surface 23 can be substantially flat. However, it is contemplated that the edge surface 23 of each leading end 22 can have any shape that preserves the functionality of the protrusions as described herein. For example, as shown in FIG. 7A, it is contemplated that the edge surface 23 of the leading end 22 can be an arcuate surface having a curvature such that the selected distance d between the leading end and the longitudinal axis L remains substantially consistent moving radially along the edge surface 23. It is further contemplated that the leading end 22 of at least one protrusion 20 of the plurality of male protrusions can optionally have a different geometric and/or angular profile from a leading end of another protrusion of the plurality of male protrusions.

In yet another optional aspect, and with reference to FIGS. 1-2 and 4-7B, each protrusion 20 of the plurality of male protrusions of the latch body 10 can define a proximal engagement surface 25 oriented substantially perpendicularly to the common longitudinal axis L of the latch body and the valve member 62 of the fluid control subassembly 60. In this aspect, the proximal engagement surface 25 of each male protrusion 20 of the plurality of male protrusions can be configured to abut the spring 66 of the fluid control subassembly 60. Thus, it is contemplated that the selected distance d between each protrusion 20 and the longitudinal axis L can be selected depending upon the outer diameter of the spring 66 and/or valve member 62. It is further contemplated that the selected distance d can be selectively varied as necessary to withstand drilling loads and vibration, thereby avoiding fatigue failure and other complications. Subject to these limitations, it is also contemplated that maximization of the selected distance d can, in turn, maximize fluid flow through the latch body 10.

Figure 4:
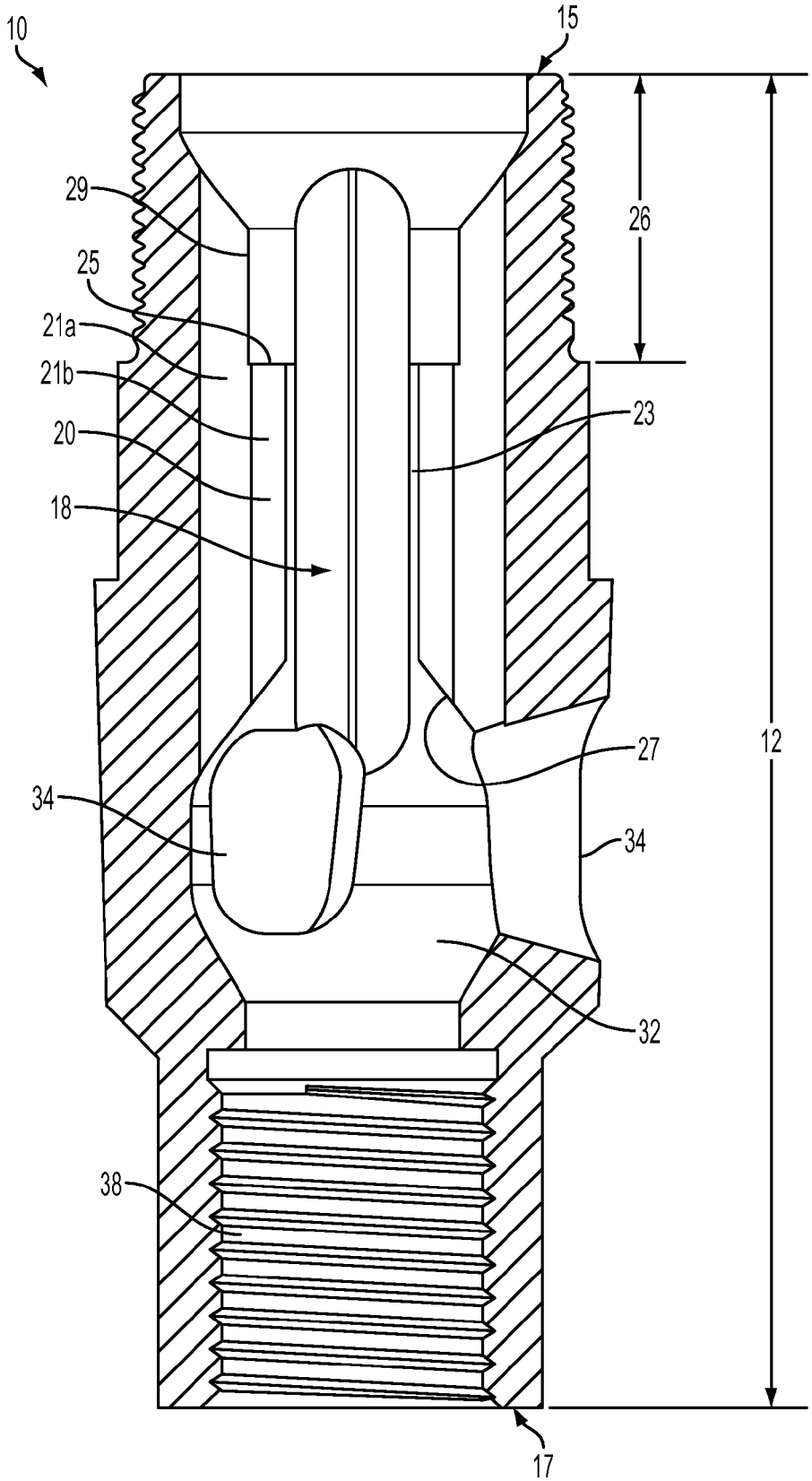
FIG. 4 is a partial cross-sectional view of an exemplary latch body having a plurality of male protrusions, a plurality of channels, and a port section as described herein. The partial cross-sectional view is taken along line 4-4 of FIGS. 6 and 7B.
Figure 5:
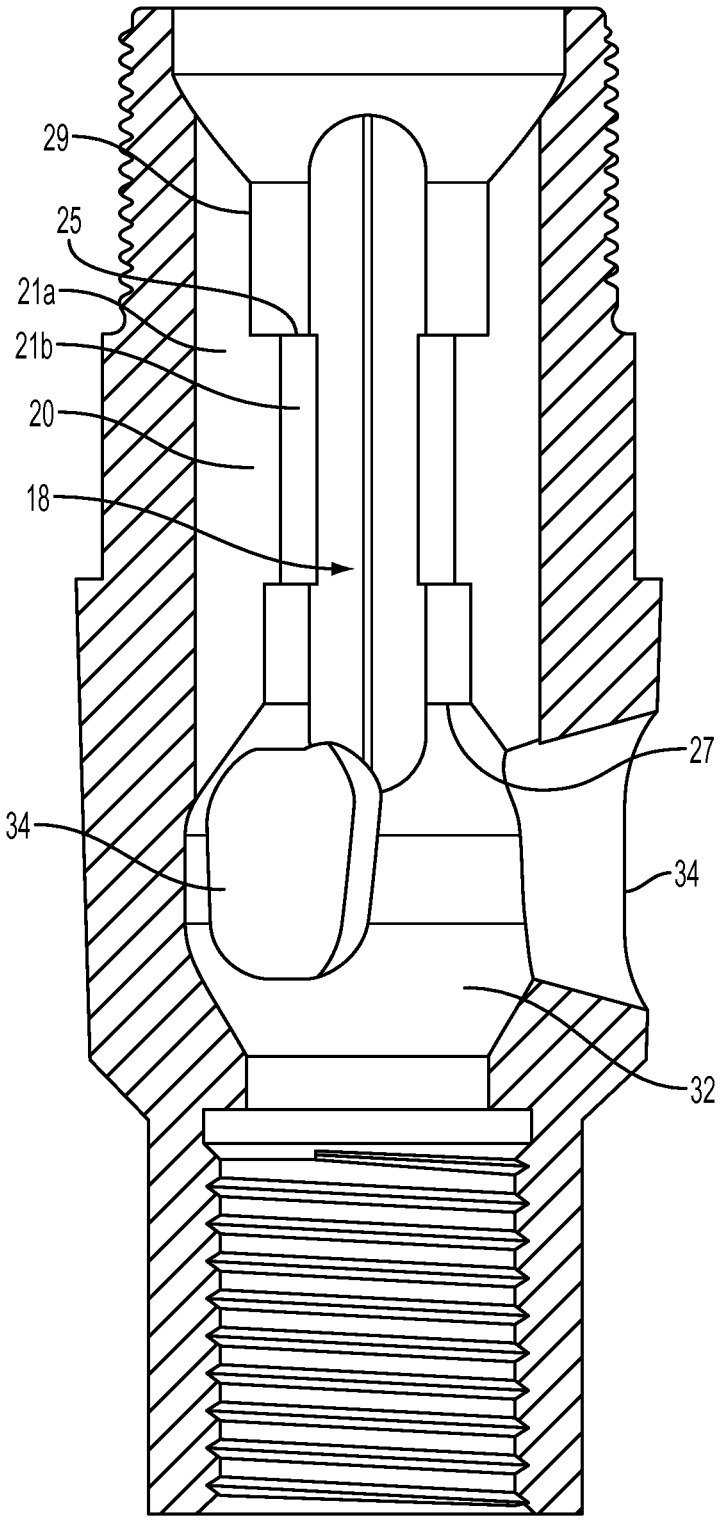
FIG. 5 is a partial cross-sectional view of another exemplary latch body having a plurality of male protrusions, a plurality of channels, and a port section as described herein. The partial cross-sectional view is taken along line 5-5 of FIG. 7A.

As shown in FIGS. 4-5, it is optionally contemplated that the proximal engagement surface 25 of each male protrusion 20 of the plurality of male protrusions can be spaced from the proximal end 15 of the latch body 10 by a selected distance 26 along the longitudinal length 12 of the latch body. It is contemplated that the selected distance 26 can be selected depending upon the longitudinal length of spring 66, with the spring being selected to provide sufficient resistance to valve member 64. In one exemplary aspect, the selected distance 26 can be less than the longitudinal length of spring 66 (when the spring is in an unstressed position), thereby permitting compressive pre-loading of the spring when the spring is positioned in engagement with the proximal engagement surfaces 25 of the male protrusions 20 and the valve member 64. Optionally, in this aspect, pre-loading of the spring can be configured to provide a high initial resistance to the valve member 64 upon contact. Alternatively, in another aspect, the latch body 10 can be configured to receive at least a portion of the spring 66 such that the spring imparts no resistance upon first contact with the valve member 64, and the bushing 68 and the valve member can be configured to cooperate with the spring to provide a desired fluid pressure response profile and/or signal. In exemplary aspects, the bushing 68 can be positioned proximate the proximal end 15 of the latch body 10; thus, it is contemplated that selected distance 26 can substantially correspond to the longitudinal spacing between the bushing 68 and the proximal engagement surfaces 25 of the latch body.

Optionally, in an exemplary aspect, the outer surface of the proximal end portion 14 of the latch body 10 can have a threaded portion. In this aspect, the threaded portion of the outer surface of the latch body 10 can extend from the proximal end 15 of the latch body along a portion of the longitudinal length 12 of the latch body. Optionally, as shown in FIGS. 4-5, it is contemplated that the distance by which the threaded portion of the outer surface of the latch body 10 extends along the longitudinal length 12 of the latch body can substantially correspond to selected distance 26.

In exemplary optional aspects, each male protrusion 20 of the plurality of male protrusions can have a base portion 21*a* and an extension portion 21*b*. In these aspects, as shown in FIGS. 6-7B, it is contemplated that the extension portion 21*b* of each male protrusion 20 can extend inwardly toward longitudinal axis L relative to the base portion 21*a*. It is further contemplated that the proximal engagement surface 25 of each male protrusion 20 can be defined by the extension portion 21*b*. In additional aspects, as shown in FIGS. 4-5, the base portion 21*a* of each male protrusion can comprise a proximal portion 29 that is positioned between the extension portion 21*b* and the proximal end 15 of the latch body 10 relative to the longitudinal axis L of the latch body.

In yet another optional aspect, and with reference to FIGS. 1-5, each protrusion 20 of the plurality of male protrusions of the latch body 10 can define (or cooperate with the inner surface of the port section 30 to define) a distal engagement surface 27. In one exemplary aspect, the distal engagement can be configured to abut the check valve element 40 upon movement of the check valve element toward the proximal end portion 14 of the latch body relative to the common longitudinal axis L of the latch body and the fluid control subassembly 60. In this aspect, as shown in FIG. 4, it is contemplated that the distal engagement surface 27 can be inwardly sloped toward the longitudinal axis L of the latch body 10 moving along the longitudinal length 12 of the latch body from the distal end 17 to the proximal end 15 of the latch body. Thus, it is contemplated that the latch body 10 can define a seat for both the check valve element 40 and the fluid control subassembly 60, including valve member 64.

In another exemplary aspect, as shown in FIG. 5, the distal engagement surface 27 can be oriented substantially perpendicularly to the longitudinal axis L of the latch body. In this aspect, the distal engagement surface 27 of each male protrusion 20 of the plurality of male protrusions can be configured to abut the spring 36 of the latch body 10.

In a further aspect, the latch body 10 can comprise a plurality of channels 28 extending radially outwardly from the longitudinal axis L of the latch body. In this aspect, it is contemplated that each channel 28 of the plurality of channels can span between the leading ends 22 of adjacent male protrusions 20. It is further contemplated that the plurality of channels 28 of the latch body 10 can be configured to permit fluid flow around the valve member 64 of the fluid control subassembly 60 and the check valve element 40 relative to the common longitudinal axis L. In exemplary aspects, each channel 28 of the plurality of channels can optionally be substantially U-shaped. However, it is contemplated that each channel 28 of the plurality of channels can have any shape that preserves the functionality of the channels 28 as described herein. It is further contemplated that at least one channel 28 of the plurality of channels can optionally have a different geometric and/or angular profile from another channel of the plurality of channels. In exemplary aspects, the plurality of channels can be formed by a pattern of drilled holes. In other exemplary aspects, it is contemplated that the plurality of channels can be formed by two perpendicular milled paths, such as can be formed using a conventional round milling bit.

In one exemplary aspect, the plurality of channels 28 can comprise four channels. However, it is contemplated that the plurality of channels 28 can comprise any number of channels that preserve the fluid flow characteristics of the latch body 10 as described herein. Thus, for example and without limitation, it is contemplated that the plurality of channels 28 can comprise three, five, six, seven, eight, nine, ten, eleven, or twelve channels.

In use, it is contemplated that the larger the channels 28 are, the less resistance will be provided to drilling fluid flow. However, it is also contemplated that the latch body 10 can comprise sufficient material to maintain drilling loads and support spring loads. Optionally, it is contemplated that the channels 28 can have a substantially symmetrical profile as measured from a plane bisecting the latch body 10 through the longitudinal axis L of the latch body. However, in other aspects, it is contemplated that the channels 28 can have an asymmetrical profile.

In exemplary aspects, the hollow spindle 50 of the drilling head assembly 100 can be operatively coupled to the chamber 32 of the port section 30 of the latch body 10. In these aspects, it is contemplated that the hollow spindle 50 can be positioned in fluid communication with the chamber 32 of the port section 30 of the latch body 10. In one aspect, the hollow spindle 50 can be configured to support the check valve element 40 in the blocking position. In this aspect, it is contemplated that this positioning of the check valve element 40 (supported between the hollow spindle 50 and housed within the chamber 32 of the port section 30 of the latch body 10) can permit fluid to flow completely through the spindle when the check valve element is in the open position. It is further contemplated that, when the latch body comprises spring 36, the spring can bias the check valve element 40 against the hollow spindle 50 in the blocking position.

Optionally, in another aspect, the distal end portion 16 of the latch body 10 can further comprise an engagement section 38 positioned in fluid communication with the chamber 32 and configured for engagement with the hollow spindle 50. In this aspect, the engagement section 38 can be positioned between the port section 30 and the distal end 17 of the latch body 10 relative to longitudinal axis L (such that the engagement section defines a portion of central bore 18). It is contemplated that the engagement section 38 can have a threaded inner surface that is configured for complementary engagement with a threaded outer surface of hollow spindle 50. However, it is understood that the engagement section 38 can comprise any known means for mechanical, axially aligned engagement.

In exemplary aspects, it is contemplated that the described drilling head assembly 100 and/or latch body 10 can provide means for confirming positioning of the latch body 10 in a drilling position. In these aspects, the drilling position can correspond to (a) the landing of the latch body 10 at the bottom and/or end of a drill hole and/or (b) the engagement between the latch body 10 and a drill string. In one aspect, when the drilling head assembly 100 and latch body 10 are used in conjunction with a landing ring as is known in the art, it is contemplated that the means for confirming positioning of the latch body 10 in a drilling position can comprise means for detecting engagement between the latch body and the landing ring and/or between an inner tube assembly and the landing ring. In another aspect, it is contemplated that the means for confirming positioning of the latch body 10 in the drilling position can comprise means for detecting fluid flow and/or pressure changes within the latch body 10. In a further aspect, when the head assembly 100 comprises a plurality of rollers, one or more detent springs, and a plurality of latches as are conventionally known in the art, it is contemplated that the means for confirming positioning of the latch body 10 in the drilling position can comprise means for rotating the head assembly 100 such that sufficient centrifugal force is created to drive one or more rollers of the head assembly radially outwardly, overcome the loading of the one or more detent springs, and deploy the plurality of latches into a drilling position. It is contemplated that rotation of the head assembly 100 in this manner can ensure drilling (latched) position of the latch body 10 is achieved. In operation, it is further contemplated that, when the latch body 10 is positioned in the drilling (latched) position, centrifugal force can drive the rollers into a locking coupling groove of the head assembly 100 and allow underlying flats under each roller to slightly rotate, thereby wedging the rollers into a locking position and driving the head assembly in rotation with a drill string.

It is contemplated that, in some variations of the described drilling head assembly 100, one or more of the various components of the latch body 10 and/or fluid control subassembly 60 can be incorporated with a variety of other downhole or uphole tools and/or objects.

It is further contemplated that the described drilling head assembly 100 and/or latch body 10 can comprise one or more of the components and features disclosed in U.S. Pat. No. 5,934,393, U.S. Pat. No. 6,029,758, U.S. Pat. No. 6,089,335, and U.S. Patent Application Publication No. 2010/0012383, each of which is incorporated herein by reference in its entirety.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A latch body for use in a drilling head assembly having a fluid control subassembly and a check valve element, the latch body having a longitudinal axis, a longitudinal length, a proximal end portion, and a distal end portion, the latch body defining a central bore extending along the longitudinal length of the latch body through the proximal and distal end portions of the latch body, the latch body comprising:

a plurality of male protrusions extending inwardly toward and spaced from the longitudinal axis of the latch body, each protrusion of the plurality of male protrusions having a leading end spaced a selected distance from the longitudinal axis of the latch body;

a plurality of channels extending radially outwardly from the longitudinal axis of the latch body, each channel of the plurality of channels spanning between the leading ends of adjacent male protrusions, wherein each channel of the plurality of channels is substantially U-shaped, wherein the distal end portion of the latch body comprises a port section, the port section defining a chamber in fluid communication with the central bore of the latch body, and at least one port in fluid communication with the chamber, wherein the chamber of the port section is configured to receive at least a portion of the check valve element, and wherein the proximal end portion of the latch body is configured to support the fluid control subassembly of the drilling head assembly in an operative position.

2. The latch body of claim 1, wherein the chamber of the port section has an inner surface configured to promote movement of the check valve element between a blocking position in which fluid flow through at least a portion of the chamber is blocked and an open position in which fluid flow through the chamber is permitted.

3. The latch body of claim 2, further comprising a spring at least partially received within the chamber of the port section, the spring being configured to bias the check valve element in the blocking position.

4. The latch body of claim 1, wherein the leading end of each protrusion of the plurality of male protrusions comprises a substantially flat edge surface.

5. A drilling head assembly comprising:

a latch body having a longitudinal axis, a longitudinal length, a proximal end portion, and a distal end portion, the latch body defining a central bore extending along the longitudinal length of the latch body through the proximal and distal end portions of the latch body, the latch body comprising:

a plurality of male protrusions extending inwardly toward and spaced from the longitudinal axis of the latch body, each protrusion of the plurality of male protrusions having a leading end spaced a selected distance from the longitudinal axis of the latch body; and a plurality of channels extending radially outwardly from the longitudinal axis of the latch body, each channel of the plurality of channels spanning between the leading ends of adjacent male protrusions, wherein each channel of the plurality of channels of the latch body is substantially U-shaped, and wherein the distal end portion of the latch body comprises a port section, the port section comprising a chamber in fluid communication with the central bore of the latch body, and at least one port in fluid communication with the chamber;

a check valve element, at least a portion of the check valve element being positioned within the chamber of the port section of the latch body;

a hollow spindle operatively coupled thereto and in fluid communication with the chamber of the port section of the latch body; and a fluid control subassembly, wherein the proximal end portion of the latch body is configured to support the fluid control subassembly in an operative position.

6. The drilling head assembly of claim 5, wherein the chamber of the port section of the latch body has an inner surface configured to promote movement of the check valve element between a blocking position in which fluid flow through at least a portion of the chamber is blocked and an open position in which fluid flow through the chamber is permitted.

7. The drilling head assembly of claim 6, wherein the hollow spindle is configured to support the check valve element in the blocking position.

8. The drilling head assembly of claim 7, wherein the latch body further comprises a spring at least partially received within the chamber of the port section, the spring being configured to bias the check valve element against the hollow spindle in the blocking position.

9. The drilling head assembly of claim 8, wherein the fluid control subassembly comprises:

a valve chamber positioned in fluid communication with the central bore of the latch body, the valve chamber having a common longitudinal axis with the latch body;

a valve member positioned within the valve chamber and configured for movement relative to the common longitudinal axis; and a spring positioned within the valve chamber such that the spring abuts the proximal end portion of the latch body and is biased against the valve member.

10. The drilling head assembly of claim 9, wherein the fluid control subassembly further comprises a bushing mounted within the valve chamber and axially surrounding at least a portion of the spring.

11. The drilling head assembly of claim 9, wherein the plurality of channels of the latch body are configured to permit fluid flow around the valve member of the fluid control subassembly and the check valve element relative to the common longitudinal axis.

12. The drilling head assembly of claim 5, wherein the leading end of each protrusion of the plurality of male protrusions of the latch body comprises a substantially flat edge surface.

13. The drilling head assembly of claim 5, wherein the fluid control subassembly comprises:

a valve chamber positioned in fluid communication with the central bore of the latch body, the valve chamber having a common longitudinal axis with the latch body;

a valve member positioned within the valve chamber and configured for movement relative to the common longitudinal axis; and a spring positioned within the valve chamber such that the spring abuts the proximal end portion of the latch body and is biased against the valve member.

14. The drilling head assembly of claim 13, wherein the fluid control subassembly further comprises a bushing mounted within the valve chamber and axially surrounding at least a portion of the spring.

15. The drilling head assembly of claim 13, wherein the plurality of channels of the latch body are configured to permit fluid flow around the valve member of the fluid control subassembly and the check valve element relative to the common longitudinal axis.

16. A drilling head assembly comprising:

a latch body having a longitudinal axis, a longitudinal length, a proximal end portion, and a distal end portion, the latch body defining a central bore extending along the longitudinal length of the latch body through the proximal and distal end portions of the latch body, the latch body comprising:

a plurality of male protrusions extending inwardly toward and spaced from the longitudinal axis of the latch body, each protrusion of the plurality of male protrusions having a leading end spaced a selected distance from the longitudinal axis of the latch body; and a plurality of channels extending radially outwardly from the longitudinal axis of the latch body, each channel of the plurality of channels spanning between the leading ends of adjacent male protrusions, wherein the distal end portion of the latch body comprises a port section, the port section comprising a chamber in fluid communication with the central bore of the latch body, and at least one port in fluid communication with the chamber;

a check valve element, at least a portion of the check valve element being positioned within the chamber of the port section of the latch body; and a fluid control subassembly having a common longitudinal axis with the latch body, the fluid control subassembly comprising:

a valve member configured for movement relative to the common longitudinal axis;

a spring positioned in abutting relation to the valve member and the proximal end portion of the latch body such that the spring is biased against the valve member; and a bushing axially surrounding at least a portion of the spring of the fluid control subassembly;

wherein the proximal end portion of the latch body is configured to support the fluid control subassembly in an operative position, and wherein each protrusion of the plurality of male protrusions of the latch body defines a proximal engagement surface oriented substantially perpendicularly to the common longitudinal axis of the latch body and the fluid control subassembly, the proximal engagement surface of each male protrusion of the plurality of male protrusions being configured to abut the spring of the fluid control subassembly.

17. The drilling head assembly of claim 16, wherein each protrusion of the plurality of male protrusions of the latch body further defines a distal engagement surface configured to abut the check valve element upon movement of the check valve element toward the proximal end portion of the latch body relative to the common longitudinal axis of the latch body and the fluid control subassembly.

18. A latch body for use in a drilling head assembly having a fluid control subassembly and a check valve element, the latch body having a longitudinal axis, a longitudinal length, a proximal end portion, and a distal end portion, the latch body defining a central bore extending along the longitudinal length of the latch body through the proximal and distal end portions of the latch body, the latch body comprising:

a plurality of male protrusions extending inwardly toward and spaced from the longitudinal axis of the latch body, each protrusion of the plurality of male protrusions having a leading end spaced a selected distance from the longitudinal axis of the latch body;

a plurality of channels extending radially outwardly from the longitudinal axis of the latch body, each channel of the plurality of channels spanning between the leading ends of adjacent male protrusions, wherein the distal end portion of the latch body comprises a port section, the port section defining a chamber in fluid communication with the central bore of the latch body, and at least one port in fluid communication with the chamber, wherein the chamber of the port section is configured to receive at least a portion of the check valve element, wherein the proximal end portion of the latch body is configured to support the fluid control subassembly of the drilling head assembly in an operative position, wherein the chamber of the port section has an inner surface configured to promote movement of the check valve element between a blocking position in which fluid flow through at least a portion of the chamber is blocked and an open position in which fluid flow through the chamber is permitted, and wherein the latch body further comprises a spring at least partially received within the chamber of the port section, the spring being configured to bias the check valve element in the blocking position.

19. The latch body of claim 18, wherein the leading end of each protrusion of the plurality of male protrusions comprises a substantially flat edge surface.

20. The latch body of claim 18, wherein each channel of the plurality of channels is substantially U-shaped.

21. A drilling head assembly comprising:

a latch body having a longitudinal axis, a longitudinal length, a proximal end portion, and a distal end portion, the latch body defining a central bore extending along the longitudinal length of the latch body through the proximal and distal end portions of the latch body, the latch body comprising:

a plurality of male protrusions extending inwardly toward and spaced from the longitudinal axis of the latch body, each protrusion of the plurality of male protrusions having a leading end spaced a selected distance from the longitudinal axis of the latch body; and a plurality of channels extending radially outwardly from the longitudinal axis of the latch body, each channel of the plurality of channels spanning between the leading ends of adjacent male protrusions, wherein the distal end portion of the latch body comprises a port section, the port section comprising a chamber in fluid communication with the central bore of the latch body, and at least one port in fluid communication with the chamber;

a check valve element, at least a portion of the check valve element being positioned within the chamber of the port section of the latch body;

a hollow spindle operatively coupled thereto and in fluid communication with the chamber of the port section of the latch body; and a fluid control subassembly, wherein the proximal end portion of the latch body is configured to support the fluid control subassembly in an operative position, wherein the chamber of the port section of the latch body has an inner surface configured to promote movement of the check valve element between a blocking position in which fluid flow through at least a portion of the chamber is blocked and an open position in which fluid flow through the chamber is permitted, wherein the hollow spindle is configured to support the check valve element in the blocking position, and wherein the latch body further comprises a spring at least partially received within the chamber of the port section, the spring being configured to bias the check valve element against the hollow spindle in the blocking position.

22. The drilling head assembly of claim 21, wherein the leading end of each protrusion of the plurality of male protrusions of the latch body comprises a substantially flat edge surface.

23. The drilling head assembly of claim 21, wherein each channel of the plurality of channels of the latch body is substantially U-shaped.

24. The drilling head assembly of claim 21, wherein the fluid control subassembly comprises:

a valve chamber positioned in fluid communication with the central bore of the latch body, the valve chamber having a common longitudinal axis with the latch body;

a valve member positioned within the valve chamber and configured for movement relative to the common longitudinal axis; and a spring positioned within the valve chamber such that the spring abuts the proximal end portion of the latch body and is biased against the valve member.

25. The drilling head assembly of claim 24, wherein the fluid control subassembly further comprises a bushing mounted within the valve chamber and axially surrounding at least a portion of the spring.

26. The drilling head assembly of claim 24, wherein the plurality of channels of the latch body are configured to permit fluid flow around the valve member of the fluid control subassembly and the check valve element relative to the common longitudinal axis.

* * * * *